United States Patent [19]

Goff et al.

[11] 4,102,628

[45] Jul. 25, 1978

[54] CONTROL APPARATUS FOR GAS BURNING APPLIANCE

[75] Inventors: Paul Frederick Goff, Warwick; Bernard William Knight, Long Itchinton; Kenneth James Prentice, Southam, all of England

[73] Assignee: Potterton International Limited, Warwick, England

[21] Appl. No.: 748,571

[22] Filed: Dec. 8, 1976

[30] Foreign Application Priority Data

Feb. 23, 1976 [GB] United Kingdom ..... 7032/76

[51] Int. Cl.[2] ..... F23Q 9/12

[52] U.S. Cl. ..... 431/43; 431/90

[58] Field of Search ..... 431/43, 44, 45, 75, 431/77, 78, 79, 80, 90

[56] References Cited

U.S. PATENT DOCUMENTS

| | | | |
|---|---|---|---|
| 3,026,867 | 3/1962 | Size | 431/43 X |
| 3,045,744 | 7/1962 | Tjermlund | 431/43 |
| 3,695,811 | 10/1972 | Brandt | 431/43 |
| 3,770,364 | 11/1973 | Walbridge | 431/78 |

*Primary Examiner*—Edward G. Favors

*Attorney, Agent, or Firm*—J. Rodman Steele, Jr.

[57] ABSTRACT

A control apparatus for a fanned, gaseous fuel-burning appliance, such as a water boiler for a domestic central heating system; the control apparatus includes electrical circuitry comprising first and second changeover switches each having a normally-closed pair of contacts and a third, normally-open contact, and a third switch; the switches are connected in a particular way to actuate gas valves and the fan of the appliance in a manner which provides improved safety features.

4 Claims, 2 Drawing Figures

6
22
1
2
3
10
9
11
8
7
4
5
18
N
14
S3
19
17
27
S2
28
15
L
26
13
S1
S4
12
S'4
R
16
25
20
L
21
23
24
23A
23B
23C
N
23C'

N
L
L
L
L
L
N

CONTROL APPARATUS FOR GAS BURNING APPLIANCE

This invention relates to control apparatus for gas burning appliances such as gas boilers for domestic central heating systems.

In our U.K. Patent Specification No. 1,425,646 we have described and claimed a control apparatus for a fanned, gaseous fuel-burning appliance which comprises a first gas valve for controlling flow of gas to a lighting jet, an electrical ignition means for igniting gas at said jet, a main gas burner disposed adjacent said lighting jet, a second gas valve for controlling flow of gas to said main burner, a first sensor for detecting the existence or non-existence of a flame at said lighting jet, a second sensor for detecting the existence or non-existence of a predetermined air flow created by an electrically driven fan means, and electrical circuitry for initiating a predetermined lighting-up sequence of the appliance only when the first sensor detects the non-existence of flame and the second sensor detects the non-existence of air flow.

Although the control apparatus described and claimed in U.K. Specification No. 1,425,646 functions quite adequately, we have now provided modifications which give even greater reliability and which have useful safety features.

According to the present invention, there is provided a control apparatus for a fanned, gaseous fuel-burning appliance which comprises a first gas valve for controlling flow of gas to a lighting jet, an electrical ignition means for igniting gas at said jet, a main gas burner disposed adjacent said lighting jet, a second gas valve for controlling flow of gas to said main burner, a first sensor for detecting the existence or non-existence of a flame at said lighting jet, a second sensor for detecting the existence or non-existence of a predetermined air flow created by an electrically driven fan means, and electrical circuitry for initiating a predetermined lighting-up sequence, said first and second sensors comprising, respectively, first and second changeover switch means each having a normally closed pair of contacts and a third, normally-open contact, and a third switch means being provided which is arranged to close on a demand for heat being indicated to the apparatus, the normally-open contact of the second switch means being connected to the common contact of the first switch means through the third switch means, the normally closed contacts of the first switch means being connected, upon the passage of electrical current thereto, to actuate the first gas valve and the normally open contact of the first switch means being connected, upon the passage of electrical current thereto, to actuate the second gas valve.

Figure 1:
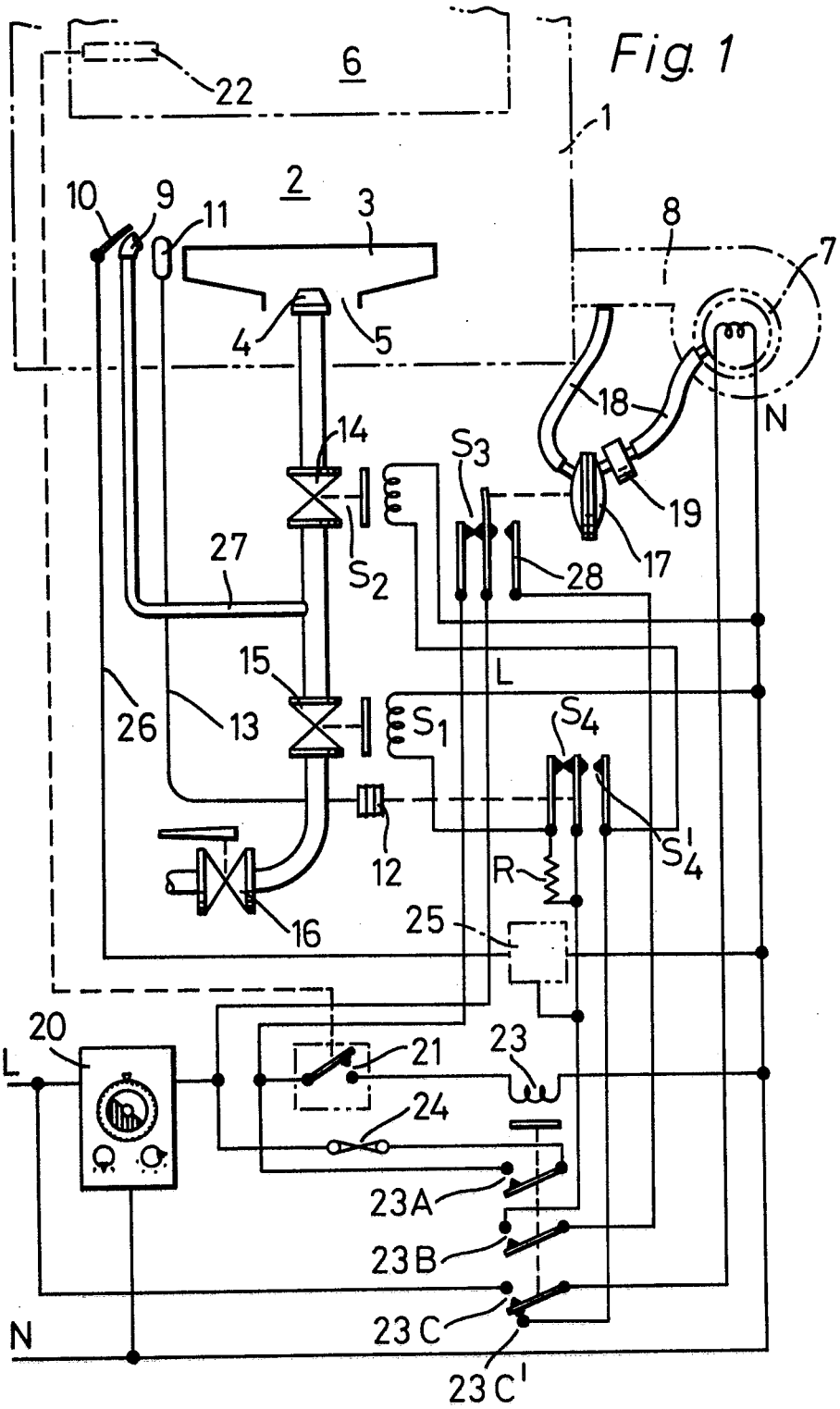
Figure 2:
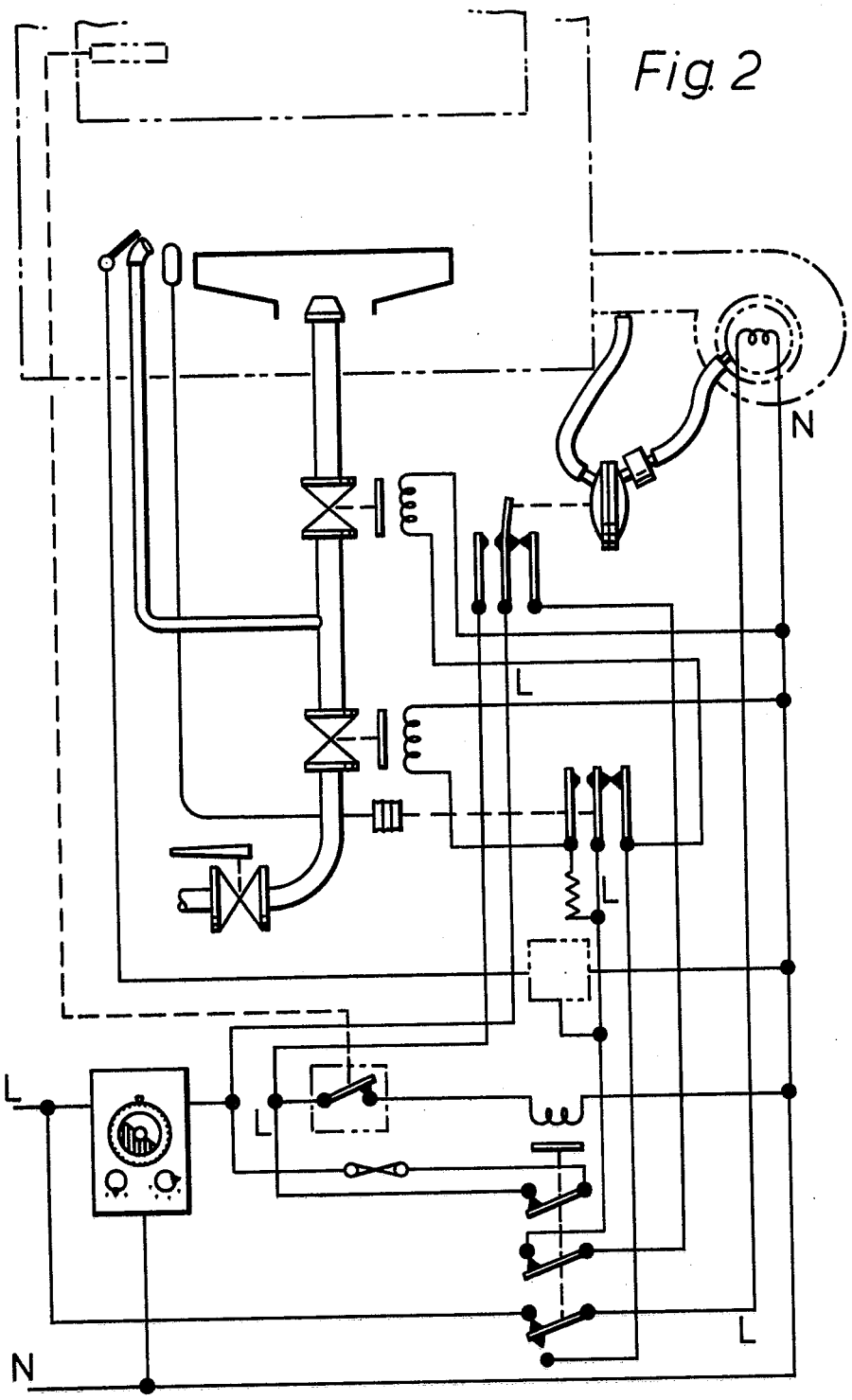

A preferred embodiment of the invention will now be described, by way of example, with reference to the accompanying drawings, in which FIG. 1 shows the preferred control apparatus in its "OFF" condition and FIG. 2 shows it in its "ON", or running condition. The control apparatus is shown incorporated in a domestic, fanned hot water boiler.

The drawings having been arranged in a manner similar to that shown in FIGS. 1 and 2 in U.K. Specification No. 1,425,646 (the teachings of which are incorporated herein by reference) and identical reference numerals for the various mechanical components have been used, where possible, throughout. A detailed description of these components is hence not necessary here - it may be obtained from U.K. Specification No. 1,425,646. However, the various integers are identified as follows: boiler casing 1, combustion chamber 2, aerated-type main burner 3, main gas jet 4, air intake 5, heat exchanger unit 6, electrically driven air fan 7, air conduit 8, lighting jet 9, spark ignition electrode 10, heat-sensitive probe 11, expansible bellows unit 12, capillary tube 13, main burner gas valve 14, main burner/-lighting jet gas valve 15, isolating cock 16, diaphragm-type pressure sensor 17, pressure sensor pipes 18, restrictor 19, programmer 20, water temperature thermostat 21, thermostat sensing element 22, relay coil 23, fuse 24, spark generator 25, high tension cable 26, lighting jet supply pipe 27, and pressure sensor switch $S_3$ with third contact 28.

The present preferred embodiment differs from that shown in FIGS. 1 and 2 in Specification No. 1,425,646 in that both gas valves 14 and 15 are electromagnetically-operated, the relay components thereof being indicated by $S_2$ and $S_1$, respectively. Relay coil 23 is provided with three pairs of normally-open relay contacts 23A, 23B, and 23C. An additional changeover switch $S_4$, under the control of the heat-sensitive probe 11, is also provided. $S_4$ has a normally-closed pair of contacts, across which is provided a resistance R. The value of R is selected such that the current flowing therethrough is insufficient to actuate $S_1$ (i.e. open valve 15) but sufficient to maintain valve 15 open once $S_4$ changes state to the position shown in FIG. 2 (see below). With no current flowing through relay coil 23, relay contacts 23A and B are open, but the common terminal of 23C is connected through a contact 23C' to a third terminal $S'_4$ of $S_4$. The electrical connections for the various components will be apparent from the drawings.

Commencing from the "OFF" condition illustrated in FIG. 1, the lighting sequence is as follows:-

(a) initially, even during an "ON" phase of the programmer 20, the live line L is isolated from the rest of the circuit other than the normally closed contacts of $S_3$ since boiler thermostat 21 is open when no demand for heat is indicated by sensor 22. Furthermore, since no current flows through relay coil 23, relay contacts 23A, B, and C are open and hence no component in the circuit is activated (FIG. 1).

(b) on a demand for heat indicated by sensor 22, boiler thermostat 21 closes, enabling current to pass through relay coil 23. Relay contacts thus close as indicated in FIG. 2.

(c) closure of contacts 23A provides a "self-latch" for the relay in a manner similar to that employed in Specification No. 1,425,645, and links the live line to the boiler thermostat irrespective of the position of the contacts of switch $S_3$.

(d) the fan 7 is actuated by current supplied through the closed relay contacts 23C.

(e) in the initial state of operation of fan 7, the valves 14 and 15 remain closed, and the spark generator remains unactuated since the third contact, 28, on $S_3$ is open and is isolated from the live line (provided to the common terminal on $S_3$).

(f) after an appropriate time delay provided by restrictor 19, $S_3$ changes over to the position indicated in FIG. 2. This enables current to be supplied to the spark generator 25 (through relay contacts 23B) and to relay $S_1$ of valve 15 through $S_4$. Valve 15 opens and the lighting jet 9 ignites. Valve 14 remains closed since it is still electrically isolated from the live line.

(g) the heat-sensitive probe 11 responds to the flame of the lighting jet 9 and causes $S_4$ to changeover to the position indicated in FIG. 2. This enables current to be supplied to relay $S_2$ of valve 14 (the live line being coupled through $S_3$, 28, 23B, and $S'_4$) causing the latter to open. Valve 15 remains open despite the changeover of $S_4$ as a result of the current flowing through resistance R. The man burner ignites. The lighting sequence is then complete.

Once the demand for heat is satisfied, the thermostat 21 opens and current is then no longer supplied to relay coil 23. The relay drops out with the relay contacts 23A, B, C reverting to their non-actuated positions shown in FIG. 1, once again isolating the live line. The fan ceases, the relays $S_1$ and $S_2$ drop-out to close valves 15 and 14, and switches $S_3$ and $S_4$ will revert to the positions indicated in FIG. 1.

The control circuit illustrated has advantages in the unlikely event of a fault, in particular should the contacts 23A, B, C weld closed, so providing an unwanted live connection to other components.

The current carried by contacts 23A for self-latching is small and these are unlikely to weld in the closed position.

If contacts 23C weld closed then this provides a permanent supply of current to the fan. The continuous running of the fan indicates the existence of such a fault.

If contacts 23B weld closed then the boiler will remain "ON" irrespective of the state of the thermostat 21. This will eventually cause the water to boil and indicate the existence of the fault.

This arises as follows. When the satisfied demand for heat causes thermostat 21 to open, contacts 23A and 23C open owing to the loss of current through relay coil 23. Contacts 23B remain welded together. Although momentarily the circuit loses connection to the live line as the contacts 23C open (and 23C' closes with the common contact of 23C), the mechanical inertia possessed by $S_3$ and $S_4$ does not allow them to revert to their positions shown in FIG. 1 quickly enough. Once 23C' is closed with the common contact of 23C, the positions shown by $S_3$ and $S_4$ in FIG. 2 are maintained since there is a direct connection to the live line arising from the connection of 23C' to $S'_4$. For as long as the programmer is in an "ON" phase, the boiler remains "ON" irrespective of the state of thermostat 21.

We claim:

1. A control apparatus for a fanned, gaseous fuel-burning appliance which comprises: a first gas valve for controlling flow of gas to a lighting jet; an electrical ignition means for igniting gas at said jet; a main gas burner disposed adjacent said lighting jet; a second gas valve for controlling flow of gas to said main burner; a first sensor for detecting the existence or non-existence of a flame at said lighting jet; a second sensor for detecting the existence or non-existence of a predetermined air flow created by an electrically driven fan means; electrical circuitry for initiating a predetermined lighting-up sequence, said first and second sensors comprising, respectively, first and second change over switch means each having a normally-closed pair of contacts and a third, normally open contact; and, electromagnetic relay means having a third switch means arranged to close on a demand for heat being indicated to the apparatus, an operating coil serially-connected with a demand-for-heat switch means, said operating coil being serially connected to an electrical supply, a fourth switch means which, upon energization of said operating coil, completes a self-holding circuit, and a fifth switch means to energize said electrically driven fan means, the normally-open contact of the second switch means being connected to the common contact of the first switch means through the third switch means, the normally-closed contacts of the first switch means being connected, upon the passage of electrical current thereto, to actuate the first gas valve and the normally-open contact of the first switch means being connected, upon the passage of electrical current thereto, to actuate the second gas valve.

2. An apparatus according to claim 1 wherein the first and second gas valves are electromagnetically operated.

3. An apparatus according to claim 1 wherein the electrical ignition means is connected between the common contact of the first switch means and one terminal of a motor winding for the fan means.

4. An apparatus according to claim 1 wherein a resistance is provided in parallel across the normally closed contacts of the first switch means.

* * * * *